US010234171B2

(12) United States Patent
Ando

(10) Patent No.: US 10,234,171 B2
(45) Date of Patent: Mar. 19, 2019

(54) ATTACHMENT STRUCTURE FOR WATER HEATER

(71) Applicant: Rinnai Corporation, Nagoya-shi, Aichi (JP)

(72) Inventor: Masakazu Ando, Nagoya (JP)

(73) Assignee: RINNAI CORPORATION, Nagoya-Shi (JP)

( * ) Notice: Subject to any disclaimer, the term of this patent is extended or adjusted under 35 U.S.C. 154(b) by 0 days.

(21) Appl. No.: 15/665,620

(22) Filed: Aug. 1, 2017

(65) Prior Publication Data

US 2018/0058720 A1 Mar. 1, 2018

(30) Foreign Application Priority Data

Aug. 25, 2016 (JP) ..... 2016-164503

(51) Int. Cl.
*F24H 9/06* (2006.01)
*F24H 9/00* (2006.01)
*F24H 9/02* (2006.01)

(52) U.S. Cl.
CPC ..... *F24H 9/06* (2013.01); *F24H 9/0005* (2013.01); *F24H 9/02* (2013.01)

(58) Field of Classification Search
CPC ..... F24H 9/06; F24H 9/0005; F24H 9/02
See application file for complete search history.

(56) References Cited

U.S. PATENT DOCUMENTS 4,955,573 A * 9/1990 Horvath ..... F24H 9/06 248/154
5,487,518 A * 1/1996 McCraney ..... F24H 9/06 248/225.11
5,761,379 A * 6/1998 Lannes ..... F24H 1/182 122/13.01

FOREIGN PATENT DOCUMENTS

DE 8501437 U1 * 4/1985
DE 19505053 A1 * 8/1996 ..... F24H 9/06
DE 29712919 U1 * 9/1997 ..... F24H 9/06

(Continued)

OTHER PUBLICATIONS

DE29712919U1—machine translation.*

(Continued)

*Primary Examiner* — Nathaniel Herzfeld
(74) *Attorney, Agent, or Firm* — Amin, Turocy & Watson LLP

(57) ABSTRACT

Provided is an attachment structure for a water heater capable of easily and securely attaching the water heater to a wall surface without performing strict alignment, and capable of fine adjustment of an attachment position of the water heater even after the attachment. The attachment structure for the water heater includes a first metal fitting (1) having a wall surface attachment portion (11) configured to be attached to a wall surface (W), and a second metal fitting (2) having an instrument attachment portion (23) configured to be attached to a back surface of the instrument body (3). In the wall surface attachment portion 11, a support portion (12) configured to hang and support a weight of the water heater is extended in a direction separate from the wall surface (W). In the instrument attachment portion (23), an engagement portion configured to engage with the support portion (12) from above is extended in a direction separate from the instrument body (3), and a lateral length of the support portion (12) is set to enough length to slide the engagement portion in a horizontal direction.

13 Claims, 4 Drawing Sheets

(56) References Cited

FOREIGN PATENT DOCUMENTS

| | | | | |
|---|---|---|---|---|
| DE | 20009046 | | 8/2000 | |
| FR | 3027100 | A1 * | 4/2016 | ..... F24H 9/06 |
| JP | 58-6140 | | 1/1983 | |
| JP | 60-118454 | | 8/1985 | |
| JP | 62-70246 | | 5/1987 | |
| JP | 1997-303883 | | 11/1997 | |
| JP | 2002-310512 | | 10/2002 | |
| JP | 2003-279162 | | 10/2003 | |
| JP | 2005-147529 | | 6/2005 | |

OTHER PUBLICATIONS

DE8501437U1—machine translation.*
Extended European Search Report for European Patent Application No. 17187872.1 dated Dec. 22, 2017.

* cited by examiner

ATTACHMENT STRUCTURE FOR WATER HEATER

BACKGROUND OF THE INVENTION

Field of the Invention

The present invention relates to an attachment structure for a water heater to attach the water heater to a wall surface or the like.

Description of the Related Art

Conventionally, as an attachment structure configured to fix a water heater to a wall surface, for example, JP-A-2002-310512 and JP-A-1997-303883 have disclosed a structure configured to attach a metal fitting to a back surface upper portion of the water heater, and to fix the metal fitting to the wall surface with screws. In this attachment structure, a screw for temporary fixing is driven into the wall surface in advance, and in a temporary fixed state where a hanging hole of the metal fitting attached to the water heater is hung on the screw, this metal fitting is fixed with the screws.

JP-A-2003-279162 has disclosed a structure where a laterally-long first metal fitting is fixed to a wall surface, and a laterally-long second metal fitting provided in a back surface of a water heater is inserted into the first metal fitting while being slid in a lateral direction to install the water heater on a wall.

JP-A-2005-147529 has disclosed a structure where a metal fitting having a bracket portion extending downward is attached to a back surface upper portion of a water heater, and this bracket portion of the metal fitting is inserted from above into an insertion space of a front-side metal plate fixed to a wall surface to install the water heater to a wall.

In the attachment structure disclosed in JP-A-2002-310512 and JP-A-1997-303884, when a strength of a wall on which a water heater is installed is weak, or when there is no wall, a wood slab or the like as the wall to install the water heater needs to be installed, for example, between pillars. It is time-consuming work. Moreover, the temporary fixing using the screw for temporary fixing and the hanging hole of the metal fitting is fixing at one point, so that strict alignment is required. Further, since the screw for temporary fixing and the hanging hole of the metal fitting are located on a back surface side of the water heater, visual check is hard, so that the temporary fixing itself is difficult work.

In the attachment structure disclosed in JP-A-2003-279162 and JP-A-2005-147529 as well, the alignment of the insertion position between the metal fitting on the water heater side and the metal fitting on the wall surface side is required, so that virtual check is hard because the respective metal fittings are located on the back surface side of the water heater.

In this manner, in the conventional example, since an attachment position of the water heater needs to be strictly aligned, the position is hard for a worker to visually check, and in addition, the water heater is large and heavy, the attachment work for the water heater is difficult, and it is a large burden for the worker to perform this work one person. Moreover, since the attachment position of the water heater has been decided, fine adjustment of the position of the water heater cannot be performed after the attachment.

Moreover, as to the attachment structure of JP-A-2003-279162, since the water heater needs to be slid in the lateral direction at the time of the attachment of the water heater, in a case where an installation place of the water heater is located in a recessed portion from another wall surface, in a case where an obstacle exists on either side of an installation place of the water heater, or the like, this attachment structure cannot be employed.

Further, as to the attachment structure of JP-A-2005-147529, there is a possibility that the bracket portion on the water heater side is not fully inserted into the insertion space of the front-side metal plate on the wall side, and is put on an upper end of the front-side metal plate in an incomplete state, and that the state is overlooked.

SUMMARY OF THE INVENTION

An object of the present invention is to provide an attachment structure for a water heater capable of performing attachment of the water heater easily and securely without strictly alignment, and capable of performing fine adjustment of an attachment position of the water heater even after the attachment.

According to the present invention, provided is an attachment structure for a water heater configured to fix the water heater to an attachment surface such as a wall surface with a metal fitting, the attachment structure including:

a first metal fitting configured to be attached to the attachment surface; and a second metal fitting configured to be attached to a back surface of the water heater, wherein the first metal fitting includes a wall surface attachment portion configured to be attached to the attachment surface, and a support portion extended from the wall surface attachment portion in a direction separate from the attachment surface, the support portion configured to engage with the second metal fitting and to hang and support a weight of the water heater, the second metal fitting includes an instrument attachment portion configured to be attached to the back surface of the water heater, and an engagement portion extended in the instrument attachment portion in a direction separate from the water heater, the engagement portion configured to engage with the support portion of the first metal fitting from above, and a lateral length of the support portion of the first metal fitting is set to enough length to slide the engagement portion of the second metal fitting in a horizontal direction.

According to the above-described configuration, in attachment work for installing the water heater to the wall surface (the attachment surface), after being lifted so that the second metal fitting is located above the first metal fitting attached to the wall surface, the water heater is lowered along the wall surface. Thereby, even if the locations of the first and second metal fittings, the worker can engage, from above, the engagement portion of the second metal fitting provided so as to be projected from the water heater with the support portion of the first metal fitting provided so as to be provided from the wall surface during the attachment work. Accordingly, the water heater can be attached to the wall surface easily and securely without strict alignment, and the worker can easily perform the attachment work for the water heater even one person.

Moreover, since the lateral length of the support portion is set to enough length for the engagement portion to slide in the horizontal direction, the water heater can be moved in the horizontal direction in the state where the second metal fitting is engaged with the first metal fitting even after the attachment of the water heater. This allows the installation position of the water heater with respect to the wall surface to be finely adjusted in the horizontal direction even after the water heater is attached to the wall surface.

Furthermore, since the support portion of the first metal fitting is extended in the direction separate from the wall surface, and the engagement portion of the second metal fitting is extended in the direction separate from the water heater, by bringing the water heater close to the wall surface and causing the back surface of the water heater to abut on the support portion, front-rear positions of the support portion and the engagement portion are defined. This prevents an incomplete engagement state where the engagement portion of the second metal fitting is put on an upper end of the support portion of the first metal fitting, so that the engagement portion and the support portion can be brought into a secure engagement state.

In the above-described attachment structure for the water heater, preferably, the second metal fitting further includes an extension portion above the engagement portion in the instrument attachment portion, the extension portion being extended from the instrument attachment portion in a direction separate from the water heater, the extension portion includes a first extension piece extended obliquely upward in the direction separate from the water heater, and a second extension piece rising from the first extension piece above the water heater in parallel to the attachment surface, the second extension piece is provided with a hole portion for wall surface fixing, and when the support portion of the first metal fitting and the engagement portion of the second metal fitting are in an engagement state, a surface of the second extension piece on an attachment surface side, and a surface of the first metal fitting on an attachment surface side are set to be located on a same plane.

Although only engaging the engagement portion with the support portion does not enable the position in the lateral direction of the water heater to be fixed, fixing to the wall surface with a screw through the hole portion for wall surface fixing of the second extension piece allows the position of the second metal fitting to be fixed, and the position in the lateral direction of the water heater to be fixed. At this time, since the engagement portion of the second metal fitting is engaged with the support portion of the first metal fitting, there is a possibility that a tension pulling out the screws is applied to the screws of the instrument attachment portion attached to the water heater. However, since the second extension piece and the wall surface attachment portion are set to be located on the same plane, even when the second extension piece is fixed to the wall surface with the screws, the tension is not applied to the screws of the instrument attachment portion, so that the attachment state of the second metal fitting to the water heater can be favorably held.

Moreover, in the second metal fitting, the first and second extension portions are projected to the wall surface side with respect to the forefront of the engagement portion. Therefore, there is a possibility that when lifting the water heater to engage the engagement portion of the second metal fitting with the support portion of the first metal fitting attached to the wall surface, the worker misunderstands that the engagement has been completed in spite of a state where a lower surface of the first extension portion abuts on the upper end of the support portion. However, the first extension portion is extended obliquely upward from an upper end of the instrument attachment portion, and thus becomes an inclined surface. Therefore, the first extension portion is not held in an engagement state with the upper end of the support portion. This enables the worker to easily recognize the attachment mistake.

In the above-described attachment structure for the water heater, preferably, the engagement portion of the second metal fitting includes an engagement piece extended obliquely downward in a direction separate from the back surface of the water heater.

Thereby, since when the engagement portion of the second metal fitting is engaged with the support portion of the first metal fitting, the engagement piece is fitted into the support portion so that the water heater is brought close to the wall surface, the positioning in the front-rear direction when the second metal fitting is hung on the first metal fitting becomes easier, so that the installation with a constant distance between the water heater and the wall surface can be performed.

In the above-described attachment structure for the water heater, preferably, a cutout portion obliquely cut out in a range excluding both ends is provided at a forefront portion of the engagement portion of the second metal fitting.

This brings the water heater into an inclined state by the cutout portion, if the engagement portion of the second metal fitting is in the incomplete state where the second metal fitting is put on the upper end of the support portion of the first metal fitting when the second metal fitting is hung on the first metal fitting. Accordingly, the worker can easily recognize the attachment mistake, and can secure the proper attachment state. Moreover, since both the ends of the forefront portion of the engagement portion are caught by the upper end of the support portion in the attachment mistake state, the water heater does not drop carelessly.

In the above-described attachment structure for the water heater, preferably, the cutout portion is formed into an M shape.

In this case, when the water heater is brought into the attachment mistake state, an inclined portion configuring the M shape in the cutout portion is necessarily caused to obliquely abut on the upper end of the support portion, so that the worker can easily recognize the attachment mistake. Moreover, both ends of the M shape are caught in the upper end of the support portion, which can prevent the water heater from dropping.

As described above, according to the present invention, the above-described first metal fitting and second metal fitting enable the water heater to be easily and securely installed on the attachment surface such as the wall surface without strict alignment, so that the worker can easily perform the attachment work even one person.

Moreover, since the lateral length of the support portion of the first metal fitting is set to enough size for the engagement portion of the second metal fitting to slide in the horizontal direction, the fixing position of the water heater can be finely adjusted in the horizontal direction with respect to the attachment surface, even after the water heater is attached to the attachment surface.

Furthermore, since when the second metal fitting is hung on the first metal fitting, the front-rear positions of the first metal fitting and the second metal fitting are defined, the incomplete state where the second metal fitting is put on the upper end of the support portion of the first metal fitting is not caused, and the water heater is installed so that the engagement portion is in the secure engagement state with the support portion.

DETAILED DESCRIPTION OF THE PREFERRED EMBODIMENT

An embodiment of the present invention will be described with reference to the drawings.

Figure 1:
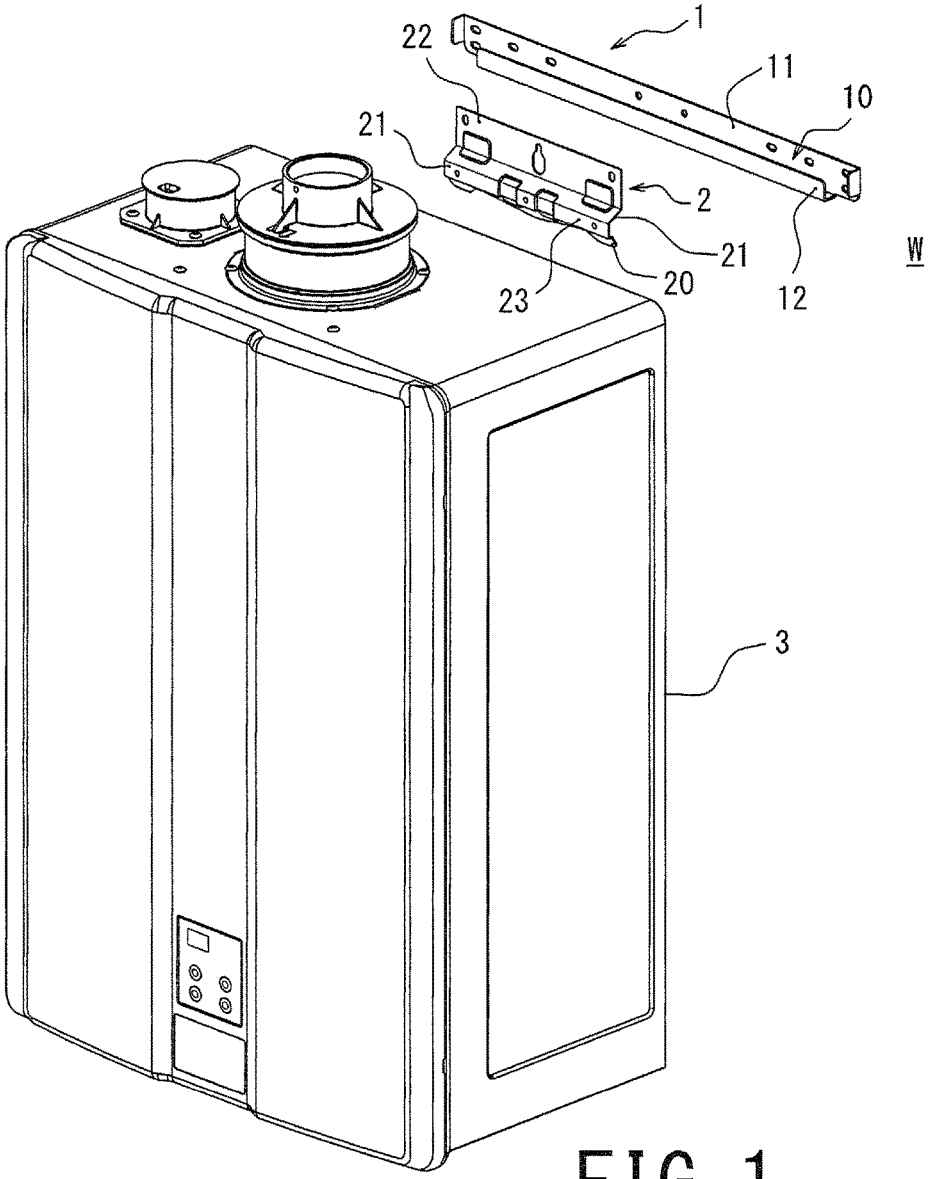
FIG. 1 is an exploded perspective view showing an instrument body as a water heater, and first and second metal fittings according to an embodiment of the present invention.
Figure 2:
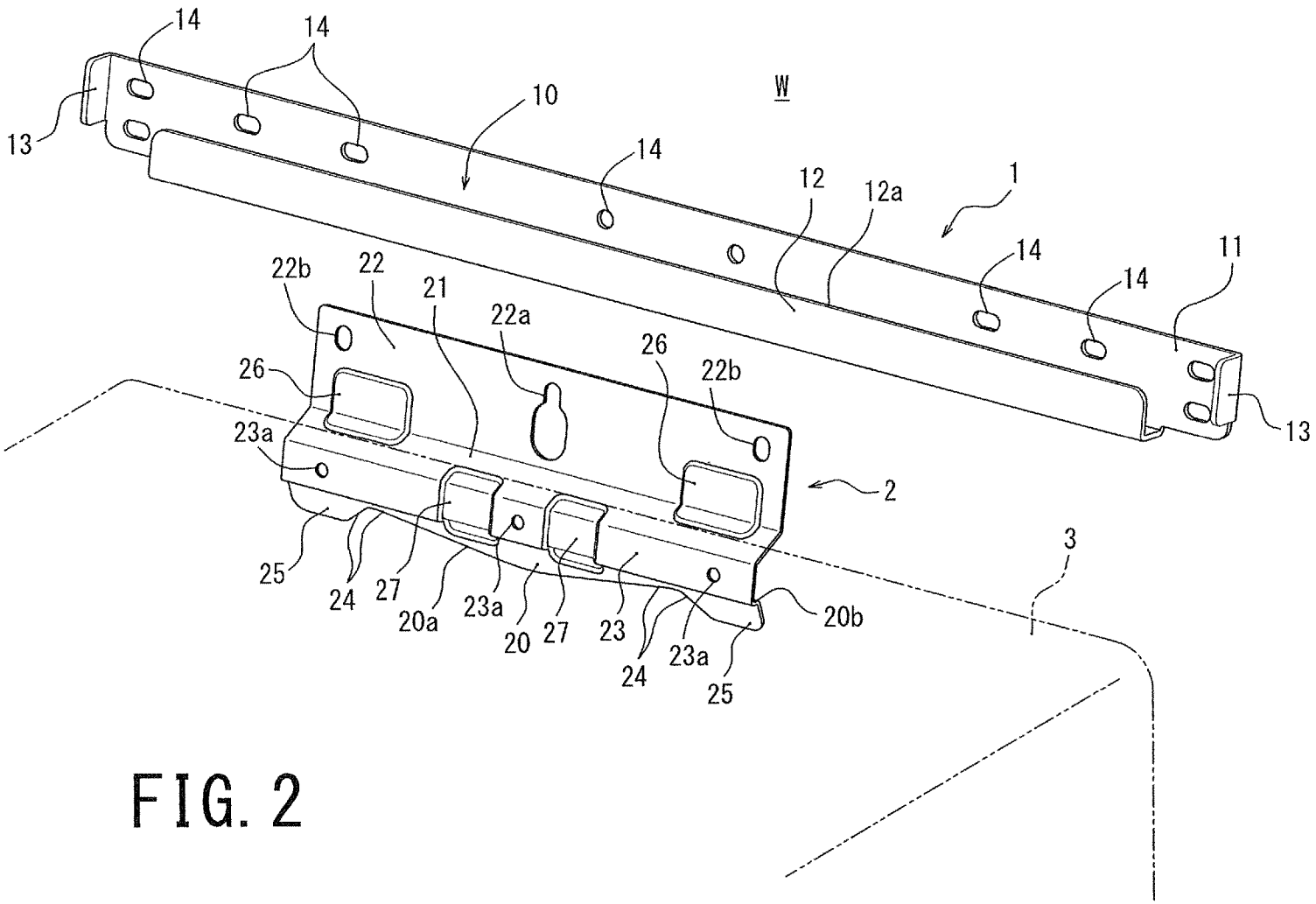
FIG. 2 is an exploded perspective view of the first and second metal fittings of the attachment structure for the water heater according to the embodiment of the present invention.
Figure 3:
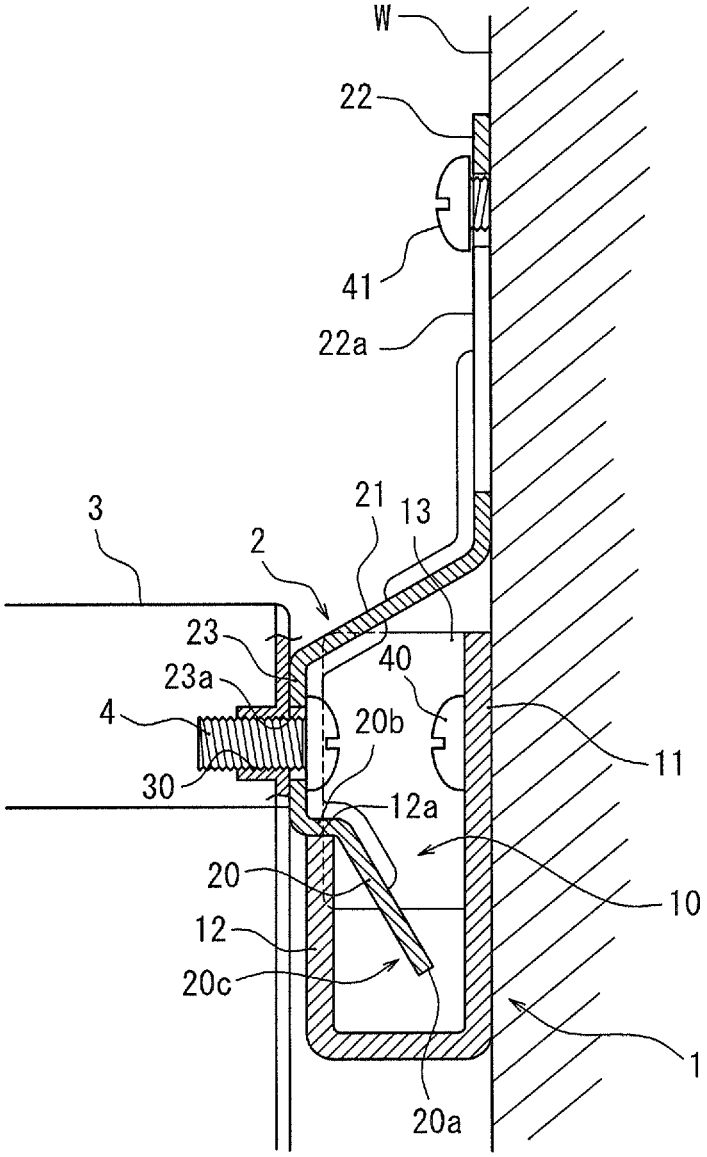
FIG. 3 is an essential part enlarged cross-sectional view showing how the instrument body of the attachment structure for the water heater according to the embodiment of the present invention is attached to a wall surface.

FIG. 1 shows an instrument body 3 of a water heater, a first metal fitting 1 configured to be attached to a wall surface W of a house as an attachment surface, and a second metal fitting 2 configured to be attached to a back surface of an instrument body 3. FIG. 2 shows the first metal fitting 1 and the second metal fitting 2. FIG. 3 shows a state where the instrument body 3 is fixed to the wall surface W in a wall hanging state through the first and second metal fittings 1, 2.

Hereinafter, a water heater side is defined as front when viewed from the wall surface W, a wall surface W side is defined as rear when viewed from the water heater, and a right-left direction of the instrument body 3 is defined as a lateral direction.

First, the first metal fitting 1 configured to be fixed to the wall surface W with screws will be described.

As shown in FIG. 1, the first metal fitting 1 is formed of a laterally-long band-like body having a length (about 450 mm) substantially matching a lateral length of the instrument body 3 of the water heater. The first metal fitting 1 includes a wall surface attachment portion 11 configured to be attached to the wall surface W, and a support portion 12 having a substantially L-shaped cross section (refer to FIGS. 2, 3). The wall surface attachment portion 11 has a plurality of through holes 14, and is attached to the wall surface W at a predetermined position in a horizontal state with anchor bolts 40 through these through holes 14. The support portion 12 is extended forward from a lower end side of the wall surface attachment portion 11, and has an extension end 12*a* facing upward.

The wall surface attachment portion 11 and the support portion 12 form a horizontal groove 10 open upward, and extending in the right-left direction. The second metal fitting 2 is engaged into this horizontal groove 10 in a slidable state in the lateral direction (horizontal direction).

At both right and left ends of the wall surface attachment portion 11, stoppers 13, 13 extending forward are projected. These right and left stoppers 13, 13 prevent the second metal fitting 2 from coming off from both right and left ends of the horizontal groove 10.

A strength of the whole first metal fitting 1 is set so that the support portion 12 can support a weight of the instrument body 3.

Next, the second metal fitting 2 will be described.

The second metal fitting 2 includes an instrument attachment portion 23 configured to be attached to the back surface of the instrument body 3 with screws, a horizontal portion 20*b* extended straightly and horizontally rearward from a lower end side of the instrument attachment portion 23, an engagement piece 20 bent from a rear end of the horizontal portion 20*b* and extended obliquely downward and rearward, a first extension portion 21 extended obliquely upward and rearward from an upper end side of the instrument attachment portion 23, and a second extension portion 22 further extended perpendicularly upward from an upper end side of the first extension portion 21. The horizontal portion 20*b* and the engagement piece 20 configure an engagement portion of the second metal fitting 2. The instrument attachment portion 23 and the second extension portion 22 are set to be located in parallel to each other.

In the vicinity of both ends of the second metal fitting 2, projected portions 26, 26 are formed in a range of the first extension portion 21 to the second extension portion 22 for reinforcement of the second metal fitting 2 (refer to FIG. 2). At two positions closer to a center of the second metal fitting 2, depressed portions 27, 27 projected in an opposite direction to the projected portions 26 are formed in a range of the first extension portion 21 to the engagement piece 20 through the instrument attachment portion 23 for reinforcement of the second metal fitting 2 (refer to FIG. 2).

At three positions of a central portion of the instrument attachment portion 23, and vicinities of both right and left ends of the same, screw insertion holes 23*a* for inserting attachment screws 4 are formed. In the vicinity of a back surface upper end of the instrument body 3 corresponding to these screw insertion holes 23*a*, screw holes 30 into which the attachment screws 4 are screwed are formed.

A lateral length of the second metal fitting 2 is shorter than a lateral length of the first metal fitting 1, and is set to about 150 mm. At a center of the second extension portion 22, a double-circular hole 22*a* having a shape in which a large diameter hole is continued under a small diameter hole is formed, as shown in FIG. 2. In the vicinity of both right and left ends of the second extension portion 22, screw insertion holes 22*b* are formed. Moreover, in a lower end edge of the engagement piece 20, a cutout portion 20*a* cut out into a substantial M shape is formed.

Next, how to attach the instrument body 3 to the wall surface W will be described.

In order to fix the instrument body 3 to the predetermined wall surface W in a wall hanging state, using the first and second metal fittings 1, 2, the first metal fitting 1 is attached to the wall surface W, and the second metal fitting 2 is attached to the instrument body 3.

The instrument attachment portion 23 is provided along the back surface of the instrument body 3 so that the screw insertion holes 23*a* of the second metal fitting 2 correspond to the screw holes 30 provided in the vicinity of a back surface upper end portion of the instrument body 3, and the attachment screws 4 inserted into the screw insertion holes 23*a* are screwed into the screw holes 30. This allows the second metal fitting 2 to be attached to the back surface of the instrument body 3. The second metal fitting 2 may be attached to the back surface of the instrument body 3 during manufacturing of the water heater.

On the other hand, at an instrument attachment position in the wall surface W, the first metal fitting 1 is disposed so that a longitudinal direction is located in the horizontal direction, and the wall surface attachment portion 11 is fixed with a plurality of anchor bolts 40 through the plurality of through holes 14. This allows the first metal fitting 1 to be attached to the wall surface W.

From the foregoing, an aspect is such that in the back surface of the instrument body 3, the first and second extension portions 21, 22 and the engagement piece 20 of the second metal fitting 2 are projected rearward so as to be separate from the instrument body 1, while in the wall surface (W), the support portion 12 of the first metal fitting 1 is projected forward so as to be separate from the wall surface W.

The instrument body 3 is lifted so that the substantially M-shaped cutout portion 20*a* of the engagement piece 20 in the second metal fitting 2 attached to the instrument body 3 is located above the extension end 12*a* of the support portion 12 of the first metal fitting 1 attached to the wall surface W, and while keeping this state, the instrument body 3 is brought close to the wall surface W side to locate the cutout portion 20*a* of the engagement piece 20 above the horizontal groove 10.

At this time, while a worker cannot visually check the engagement piece 20 and the support portion 12, the worker lifts and moves the instrument body 3 to the wall surface W side with a rough estimate, and at a time point when the second extension portion 22 of the second metal fitting 2 abuts on the wall surface W above the first metal fitting 1, or in a state where the back surface of the instrument body 3 abuts on a front surface of the support portion 12 of the first metal fitting 1, the instrument body 3 is lowered along the wall surface W. This allows the horizontal portion 20*b* to be engaged with the extension end 12*a* in a state where the engagement piece 20 is fitted into the horizontal groove 10 of the support portion 12.

Before the second extension portion 22 abuts on the wall surface W, an inclined surface 20*c* of the engagement piece 20 is caused to abut on the extension end 12*a* of the support portion 12 and is slid, which enables the instrument body 3 to move in a front-rear direction. Since the lateral length of the second metal fitting 2 is set shorter than that of the first metal fitting 1, the second metal fitting 2 can slide rightward and leftward with respect to the extension end 12*a* of the support portion 12. Thus, a position of the instrument body 3 can be adjusted in the front-rear and right-left directions. Further, in a state where the instrument body 3 is positioned at the predetermined position on the wall surface W, a positioning screw 41 is screwed into the wall surface W through the double-circular hole 22*a* provided at the center of the second extension portion 22 of the second metal fitting 2. This allows the instrument body 3 to be attached in the positioned state.

Moreover, when other bolts (not shown) are fixed to the wall surface W through the screw insertion holes 22*b* provided in the vicinity of both the ends of the second extension portion 22, the second metal fitting 2 can be fixed securely and robustly at the predetermined position of the wall surface W in the state where the horizontal portion 20*b* of the engagement piece 20 is engaged with the extension end 12*a* of the support portion 12 of the first metal fitting 1. The screw fixing may be performed only through the screw insertion holes 22*b* without using the double-circular hole 22*a*.

When the engagement piece 20 is in a state properly engaged with the extension end 12*a* of the support portion 12, a back surface of the second extension portion 22 is set so as to be located on the same plane as a back surface of the wall surface attachment portion 11. This prevents the instrument attachment portion 23 from being forcibly pulled rearward when the second extension portion 22 is fixed to the wall surface W with the positioning screw 41 or the other bolts. That is, a force in a direction causing each of the attachment screws 4 to come off rearward does not act on the attachment screw 4, so that the attachment state of the second metal fitting 2 to the instrument body 3 can be held favorably. Thus, the instrument body 3 can be fixed to the wall surface W in the stable state.

Moreover, the second extension portion 22 configured to be attached to the wall surface W and the instrument attachment portion 23 configured to be attached to the instrument body 3 are set so as to be located in parallel to each other, and thus, the instrument body 3 can be attached so as to be located in parallel to the wall surface W in the proper attachment state.

From the foregoing, only by engaging, from above, the engagement piece 20 of the second metal fitting 2 attached to the instrument body 3 with the support portion 12 of the first metal fitting 1 attached to the wall surface W, the instrument body 3 can be temporarily fixed to the wall surface W. Accordingly, the worker can easily and securely perform the work for fixing the instrument body 3 to the wall surface even one person.

At both ends of the first metal fitting 1, the stoppers 13 are provided. Accordingly, when the second metal fitting 2 is slid rightward and leftward on the extension end 12*a* of the support portion 12 in the state where the engagement piece 20 is inserted into the horizontal groove 10 to perform the position adjustment, even if the second metal fitting 2 is slid rightward or leftward too much, the second metal fitting 2 abuts on the stopper 13 of the first metal fitting 1, and there is no inconvenience that the second metal fitting 2 drops from the first metal fitting 1 carelessly.

Figure 4:
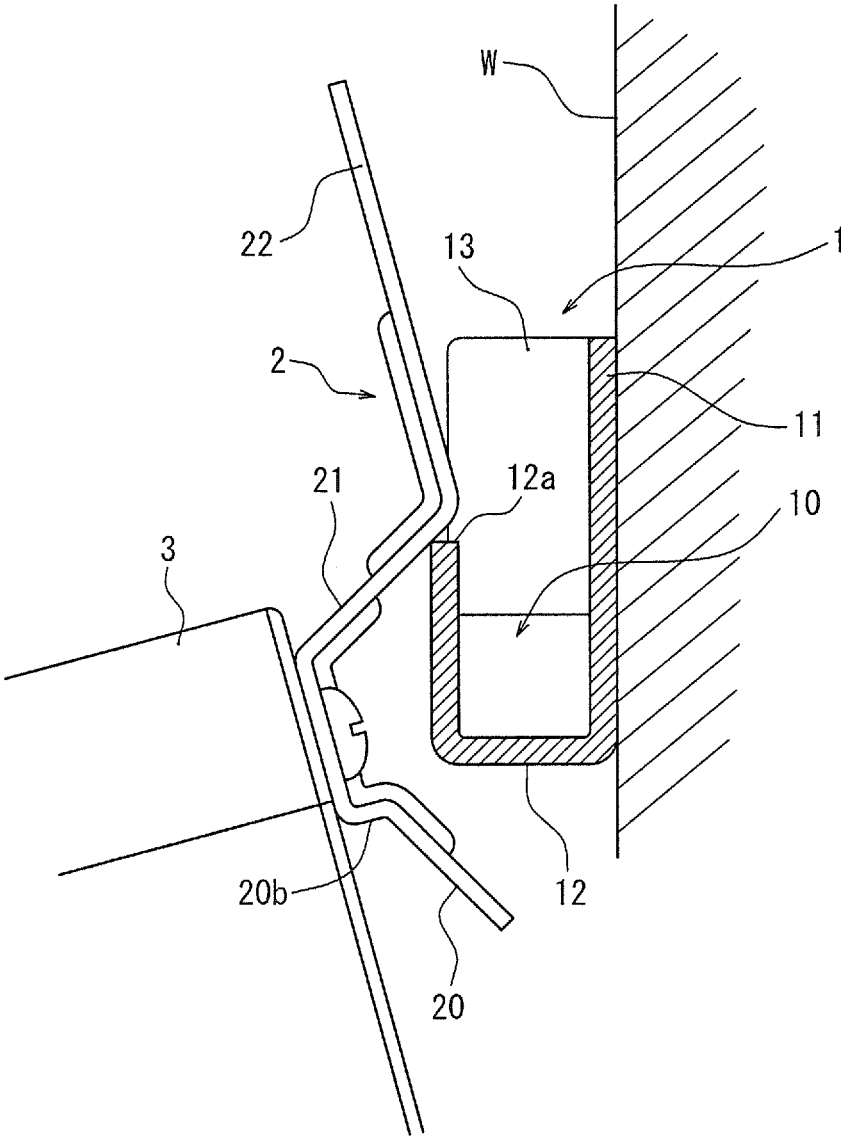
FIG. 4 is an explanatory view showing one example of an attachment mistake of the attachment structure for the water heater according to the embodiment of the present invention.

When the second metal fitting 2 attached to the instrument body 3 is engaged with the first metal fitting 1 attached to the wall surface W, if a lifting height of the instrument body 3 is insufficient, as shown in FIG. 4, an extension end of the first extension portion 21 protruded rearward from the engagement piece 20 may abut on the extension end 12*a* of the support portion 12. In this case, since the first extension portion 21 is an inclined surface extending rearward and obliquely upward, the instrument body 3 cannot be disposed straightly with respect to the first metal fitting 1, or the first extension portion 21 as the inclined surface is not maintained in a state locked by the extension end 12*a* of the support portion 12. As a result, the first extension portion 21 slips down. Thus, the worker can easily recognize an attachment mistake of the second metal fitting 2 to the first metal fitting 1, and the instrument body 3 is not attached to the wall surface W in a wrong engagement state.

Moreover, since a cutout portion 20*a* of the engagement piece 20 is formed into a substantially M shape, in a lower end of the engagement piece 20, a portion other than both ends is formed of an oblique side 24. Thus, even if the cutout portion 20*a* of the engagement piece 20 is locked by the extension end 12*a* of the support portion 12 by mistake, it is locked by the oblique side 24, and thus, the instrument body 3 is locked in an inclined state. Thus, in this case as well, the worker can easily recognize the attachment mistake. Even if a hand is left from the instrument body 3 in a state where the substantially M-shaped oblique side 24 is hung on the extension end 12*a* of the support portion 12, both ends 25 in the substantial M shape are engaged with the extension end 12*a* of the support portion 12, so that there is no risk that the instrument body 3 drops.

In the above-described embodiment, the support portion 12 of the first metal fitting 1 has a substantially L-shaped cross-sectional shape projected forward from the lower end of the wall surface attachment portion 11 of the first metal fitting 1. However, as long as the horizontal groove 10 open upward can be formed, a configuration of projecting so as to form a substantially V-shaped cross-sectional shape can be employed. Further, a configuration may be such that the support portion 12 is projected directly forward and obliquely upward from the wall surface attachment portion 11 to form an upward-open, substantially V-shaped cross section together with the wall surface attachment portion 11. Moreover, a projection position of the support portion 12 is not limited to the lower end of the wall surface attachment portion 11, but the shape may be such that the support portion 12 is projected forward, or obliquely upward and forward from a central portion or the upper end of the wall surface attachment portion 11.

The shape of the second metal fitting 2 is not limited to the shape in FIG. 2, either, but the engagement portion may be projected rearward from a central portion of the instrument attachment portion 23, and the cross-sectional shape thereof can also be a substantial inverted L shape or inverted V shape.

Further, the shape of the cutout portion 20*a* is not limited to the substantial M shape, either, but cutting out into any other shape having the oblique side 24 is possible.

The invention claimed is:

1. An attachment structure for a water heater configured to fix the water heater to an attachment surface such as a wall surface with a metal fitting, the attachment structure comprising:

a first metal fitting configured to be attached to the attachment surface; and a second metal fitting configured to be attached to a back surface of the water heater, wherein the first metal fitting comprises a wall surface attachment portion configured to be attached to the attachment surface, and a support portion extended from the wall surface attachment portion in a direction separate from the attachment surface, the support portion configured to engage with the second metal fitting and to hang and support a weight of the water heater, the second metal fitting comprises:

an instrument attachment portion configured to be attached to the back surface of the water heater;

an engagement portion extended in the instrument attachment portion in a direction separate from the water heater, the engagement portion configured to engage with the support portion of the first metal fitting from above; and an extension portion extending from the instrument attachment portion in a direction separate from the water heater; when the support portion of the first metal fitting and the engagement portion of the second metal fitting are in an engagement state, an attachment surface side of the extension portion and the wall surface attachment portion are located on a same plane; and a lateral length of the support portion of the first metal fitting is set to enough length to slide the engagement portion of the second metal fitting in a horizontal direction.

2. The attachment structure for the water heater according to claim 1, wherein the second metal fitting is above the engagement portion in the instrument attachment portion, the extension portion comprises a first extension piece extended obliquely upward in the direction separate from the water heater, and a second extension piece rising from the first extension piece above the water heater in parallel to the attachment surface, the second extension piece is provided with a hole portion for wall surface fixing, and the attachment surface side of the extension portion is located on the second extension piece.

3. The attachment structure for the water heater according to claim 1 or claim 2, wherein the engagement portion of the second metal fitting comprises an engagement piece extended obliquely downward in a direction separate from the back surface of the water heater.

4. The attachment structure for the water heater according to claim 1 or claim 2, wherein a cutout portion obliquely cut out in a range excluding both ends is provided at a forefront portion of the engagement portion of the second metal fitting.

5. The attachment structure for the water heater according to claim 3, wherein a cutout portion obliquely cut out in a range excluding both ends is provided at a forefront portion of the engagement portion of the second metal fitting.

6. The attachment structure for the water heater according to claim 4, wherein the cutout portion is formed into an M shape.

7. The attachment structure for the water heater according to claim 5, wherein the cutout portion is formed into an M shape.

8. An attachment structure for a water heater configured to fix the water heater to an attachment surface such as a wall surface with a metal fitting, the attachment structure comprising:

a first metal fitting configured to be attached to the attachment surface; and a second metal fitting configured to be attached to a back surface of the water heater, wherein the first metal fitting comprises a wall surface attachment portion configured to be attached to the attachment surface, and a support portion extended from the wall surface attachment portion in a direction separate from the attachment surface, the support portion configured to engage with the second metal fitting and to hang and support a weight of the water heater, the second metal fitting comprises:

an instrument attachment portion configured to be attached to the back surface of the water heater;

an engagement portion extended in the instrument attachment portion in a direction separate from the water heater, the engagement portion configured to engage with the support portion of the first metal fitting from above;

an extension portion above the engagement portion in the instrument attachment portion, the extension portion being extended from the instrument attachment portion in a direction separate from the water heater, the extension portion comprises a first extension piece extended obliquely upward in the direction separate from the water heater, and a second extension piece rising from the first extension piece above the water heater in parallel to the attachment surface, the second extension piece is provided with a hole portion for wall surface fixing, and when the support portion of the first metal fitting and the engagement portion of the second metal fitting are in an engagement state, a surface of the second extension piece on an attachment surface side, and a surface of the first metal fitting on an attachment surface side are set to be located on a same plane; and a lateral length of the support portion of the first metal fitting is set to enough length to slide the engagement portion of the second metal fitting in a horizontal direction.

9. The attachment structure for the water heater according to claim 8, wherein the engagement portion of the second metal fitting comprises an engagement piece extended obliquely downward in a direction separate from the back surface of the water heater.

10. The attachment structure for the water heater according to claim 8, wherein a cutout portion obliquely cut out in a range excluding both ends is provided at a forefront portion of the engagement portion of the second metal fitting.

11. The attachment structure for the water heater according to claim 9, wherein a cutout portion obliquely cut out in a range excluding both ends is provided at a forefront portion of the engagement portion of the second metal fitting.

12. The attachment structure for the water heater according to claim 10, wherein the cutout portion is formed into an M shape.

13. The attachment structure for the water heater according to claim 11, wherein the cutout portion is formed into an M shape.

* * * * *